US006850828B2

(12) United States Patent
Chen

(10) Patent No.: US 6,850,828 B2
(45) Date of Patent: Feb. 1, 2005

(54) CONTROL APPARATUS AND CONTROL METHOD FOR A FORKLIFT AND FORKLIFT

(75) Inventor: Shuming Chen, Kyoto (JP)

(73) Assignee: Nippon Yusoki Co., Ltd., Kyoto (JP)

( * ) Notice: Subject to any disclaimer, the term of this patent is extended or adjusted under 35 U.S.C. 154(b) by 124 days.

(21) Appl. No.: 10/260,298

(22) Filed: Oct. 1, 2002

(65) Prior Publication Data

US 2003/0167114 A1 Sep. 4, 2003

(30) Foreign Application Priority Data

Mar. 1, 2002 (JP) ..... P2002-056244

(51) Int. Cl.[7] ..... G06G 7/76; B66F 9/06
(52) U.S. Cl. ..... 701/50
(58) Field of Search ..... 701/36, 50; 37/414; 60/422, 424, 911

(56) References Cited

U.S. PATENT DOCUMENTS 5,832,730 A * 11/1998 Mizui ..... 60/469
6,308,516 B1 * 10/2001 Kamada ..... 60/450

FOREIGN PATENT DOCUMENTS

| | | | |
|---|---|---|---|
| DE | 10 021 823 | A1 | 11/2001 |
| GB | 2 360 757 | A | 10/2001 |
| JP | 2-163300 | A | 6/1990 |
| JP | 2-215700 | A | 8/1990 |
| JP | 3-138300 | A | 6/1991 |
| JP | 7-125994 | A | 5/1995 |
| JP | 8-133698 | A | 5/1996 |
| JP | 11-165995 | A | 6/1999 |

* cited by examiner

*Primary Examiner*—Thu V. Nguyen
(74) *Attorney, Agent, or Firm*—Sughrue Mion, PLLC

(57) ABSTRACT

A control apparatus includes a target acceleration obtaining device for obtaining a target acceleration of a hydraulic motor based on an operation amount of a lift lever; a torque command value obtaining device for obtaining a torque command value of a hydraulic motor based on the target acceleration; a determining device for determining as a non-regeneration state or as a regeneration state based the torque command value; and a change-over control device for changing over a change-over member so as to couple a lift cylinder to a flow rate control valve when determined as the non-regeneration state, and for changing over the change-over member so as to couple the lift cylinder to a hydraulic pump and making an inverter controller control the hydraulic motor in accordance with the torque command value when determined as the regeneration state.

9 Claims, 6 Drawing Sheets

CONTROL APPARATUS AND CONTROL METHOD FOR A FORKLIFT AND FORKLIFT

BACKGROUND OF THE INVENTION

1. Field of the Invention

The present invention relates to a control apparatus and a method for a forklift provided with a hydraulic pump and a hydraulic motor for operating a lift cylinder for lifting up and down a fork.

2. Description of the Related Art

Conventionally, as a cargo apparatus for a forklift used for loading and unloading a baggage, ones being operated by hydraulic pressure have been employed. The hydraulic circuit of such a cargo apparatus is configured as shown in FIG. 6, for example. That is, a lift cylinder 3 for lifting up and down a fork 1 is coupled to a hydraulic pump 9 through a fuse valve 5 and a lift control valve (hereinafter called as a lift valve) 7 which is changed over between a lift-up side (the left side in FIG. 6) and a lift-down side (the right side in FIG. 6) by the operation of a lift lever. The hydraulic pump 9 is driven by a hydraulic motor 11, whereby oil reserved within an oil tank 13 is supplied to the lift cylinder 3. A reference numeral 8 depicts a check valve provided at a path between the hydraulic pump 9 and the lift valve 7.

Further, as shown in FIG. 6, a reach cylinder 15 for moving the fork 1 in the forward and backward direction is coupled to a reach control valve (hereinafter called as a reach valve) 17 which is changed over between a reach-in side (the left side in FIG. 6) and a reach-out side (the right side in FIG. 6) by the operation of a reach lever. The reach valve 17 is coupled to the hydraulic pump 9 through a check valve 19 and also coupled to the oil tank 13.

Further, as shown in FIG. 6, a tilt cylinder 21 for tilting the fork 1 is coupled to a tilt control valve (hereinafter called as a tilt valve) 23 which is changed over between a tilt-up side (the left side in FIG. 6) and a tilt-down side (the right side in FIG. 6) by the operation of a tilt lever. The tilt valve 23 is coupled to the hydraulic pump 9 through a check valve 25 and also coupled to the oil tank 13.

Furthermore, as shown in FIG. 6, a relief valve 27 is disposed between a coupling tube on the oil tank 13 side of the reach valve 17 and a coupling tube on the oil tank 13 side of the tilt valve 23. The fuse valve 5 and a flow rate control valve 29 are disposed between the coupling tube of the lift cylinder 3 and the coupling tube of the lift valve 7. In particular, when the lift cylinder 3 is lifted down, a flow rate of the oil to be fed back to the oil tank 13 is controlled by the flow rate control valve 29. A check valve 31 is coupled in parallel to the flow rate control valve 29.

However, according to the aforesaid conventional configuration, when the fork 1 is lifted down from a high position, the oil is merely fed back from the lift cylinder 3 to the oil tank 13 through the fuse valve 5 and the flow rate control valve 29 without using the potential energy of the fork 1. Thus, this potential energy is wasted.

In particular, when a baggage is loaded on the fork 1, since the weight of the baggage is added to the dead weight of the fork 1, the potential energy becomes very large. Thus, it is desired to effectively utilize such a large potential energy.

Further, the speed or the maximum speed of the fork at the time of the lift-down thereof is determined by the dead weight of the fork 1, the weight of a baggage, an opening degree of the lift valve 7 and the characteristics of the flow rate control valve 29. Thus, particularly, in the fully opened state of the lift valve 7, there arises a problem that it is difficult to control the speed at the lift-down operation to a desired speed.

However, conventionally, it has been considered to use a DC motor for the hydraulic motor and to regenerate the potential energy of the fork to a battery serving as a driving source, during the time of the lift-down operation. However, in the case of using the DC motor, since a regeneration control circuit is required in addition to a normal driving control circuit, the configuration of the control circuit becomes complicated and expensive. Thus, there arises an inconvenience that although the potential energy can be utilized, economical efficiency is degraded.

SUMMARY OF THE INVENTION

Accordingly, an object of the invention is to provide a control apparatus and a method for a forklift that can regenerate and effectively use potential energy at the time of the lift down operation of a fork and control the lift-down speed of the forks to a desired speed accurately.

In order to attain the aforesaid object, there is provided a control apparatus for a forklift having a lift lever; a hydraulic motor; a hydraulic pump; an oil tank; and a lift cylinder, wherein, at a time of a lift-up operation based on an operation of the lift lever, the hydraulic motor drives the hydraulic pump to supply oil from the oil tank to a lift cylinder by the hydraulic pump thereby to extend the lift cylinder, whilst at a time of a lift-down operation based on an operation of the lift lever, the oil is collected to the oil tank from the lift cylinder due to a shrinking operation of the lift cylinder, the control apparatus including: an inverter controller for controlling an output of the hydraulic motor; a flow rate control valve, coupled to the oil tank, for limiting a flow rate of the oil collected to the oil tank; a change-over member for selectively coupling the lift cylinder to the flow rate control valve or to the hydraulic pump; an operation amount detector for detecting an operation amount of the lift lever; a target acceleration obtaining means for obtaining a target acceleration of the hydraulic motor based on the operation amount detected by the operation amount detector; a torque command value obtaining means for obtaining a torque command value of the hydraulic motor based on the target acceleration; a determining means for determining as a non-regeneration state or as a regeneration state, based the torque command value; and a change-over control means for changing over the change-over member so as to couple the lift cylinder to the flow rate control valve when determined as the non-regeneration state, and for changing over the change-over member so as to couple the lift cylinder to the hydraulic pump and making the inverter controller control the hydraulic motor in accordance with the torque command value when determined as the regeneration state.

According to such a configuration, the torque command value of the hydraulic motor is obtained by the torque command value obtaining means based on the target acceleration obtained by the target acceleration obtaining means, and determination is made as to whether it is the non-regeneration state or the regeneration state based on the torque command value thus obtained. When it is determined to be the non-regeneration state, the change-over control means changes over the change-over member to a side where the lift cylinder is coupled to the flow rate control valve. In contrast, when it is determined to be the regeneration state, the change-over control means changes over the change-over member to a side where the lift cylinder is coupled to the hydraulic pump and the hydraulic motor is controlled by the inverter controller.

Thus, when it is determined that the regeneration is impossible and determined as the non-regeneration state at the time of the lift-down operation, the change-over member is changed over to couple the lift cylinder to the flow rate control valve, whereby the lift-down operation like the conventional technique can be performed.

In contrast, when it is determined to be the regeneration state at the time of the lift-down operation, the change-over member is changed over so as to couple the lift cylinder to the hydraulic motor thereby to control the hydraulic motor. Thus, the potential energy of the forks and the potential energy of a baggage can be regenerated and utilized effectively.

The change-over member may be provided with an electromagnetic type change-over valve. According to such a configuration, the change-over member can be controlled so as to be changed over with good responsibility in accordance with an electric signal from the outside.

The operation amount detector may be formed by a potentiometer for detecting operation amounts of the lift lever operated to a lift-up side and to a lift-down side. According to such a configuration, the potentiometer can detect whether the lift lever is operated to the lift-up side or to the lift-down side and also can detect the operation amount of the lift lever accurately.

The invention may further includes a speed detector for detecting an actual rotation speed of the hydraulic motor, wherein the target acceleration obtaining means obtains an actual acceleration of the hydraulic motor based on the actual rotation speed detected by the speed detector and obtains the target acceleration of the hydraulic motor based on the operation amount detected by the operation amount detector, and wherein the torque command value obtaining means obtains the torque command value based on a difference between the actual acceleration and the target acceleration.

According to such a configuration, the actual acceleration of the hydraulic motor is obtained by the target acceleration obtaining means based on the rotation speed detected by the speed detector, and the target acceleration is obtained based on the operation amount of the lift lever detected by the operation amount detector. The torque command value is obtained based on the difference between the actual acceleration and the target acceleration by the torque command value obtaining means. Thus, it is possible to accurately determine as to whether it is the non-regeneration state or the regeneration state and also the output of the hydraulic motor can be controlled suitably.

The target acceleration obtaining means may includes a storage portion for storing relation data representing relation between the actual rotation speed and the target acceleration, and the target acceleration obtaining means obtains a target speed of the hydraulic motor based on the operation amount of the lift lever, then reads the relation data from the storage portion, and obtains the target acceleration through calculation using the actual rotation speed, the target speed and the relation data.

According to such a configuration, the target acceleration obtaining means obtains the target speed of the hydraulic motor based on the operation amount of the lift lever, then reads out the relation data from the storage portion storing the relation data representing relation between the actual rotation speed and the target acceleration, and obtains the target acceleration through the calculation using the target speed and the relation data between the actual rotation speed and the target acceleration.

The determining means may determine that it is the non-regeneration state when the torque command value obtained by the torque command value obtaining means is equal to or more than a predetermined value and determine that it is the regeneration state when the torque command value is less than the predetermined value.

According to such a configuration, the determining means determines that it is the non-regeneration state when the torque command value obtained by the torque command value obtaining means is equal to or more than the predetermined value and determines that it is the regeneration state when the torque command value is less than the predetermined value. Thus, the determination as to whether it is the non-regeneration state or the regeneration state can be performed suitably by merely setting in advance the suitable predetermined value according to the characteristics of the hydraulic motor and a desired lift-down speed etc.

The invention may further include: a cylinder different from the lift cylinder; an operation lever different from the lift lever; and an operation detector for detecting an operation of the operation lever, wherein the cylinder performs an extending operation or a shrinking operation in response to the oil supplied by the hydraulic pump driven by the hydraulic motor based on an operation of the operation lever; and wherein the determining means determines as the non-regeneration state when the operation of the operation lever is detected by the operation detector irrespective of the torque command value.

According to such a configuration, when the operation of the operation lever different from the lift lever is detected by the operation detector, the determining means determines that it is the non-regeneration state irrespective of the torque command value. Thus, the oil can be supplied from the hydraulic pump to the cylinder different from the lift cylinder without causing any trouble, so that there is no fear that the working efficiency is degraded.

Also, there is provided a method of controlling a forklift having a lift lever; a hydraulic motor; a hydraulic pump; an oil tank; a lift cylinder; and a flow rate control valve coupled to the oil tank, wherein, at a time of a lift-up operation based on an operation of the lift lever, the hydraulic motor drives the hydraulic pump to supply oil from the oil tank to a lift cylinder by the hydraulic pump thereby to extend the lift cylinder, whilst at a time of a lift-down operation based on an operation of the lift lever, the oil is collected to the oil tank from the lift cylinder due to a shrinking operation of the lift cylinder, the method comprising: detecting an operation amount of the lift lever; obtaining a target acceleration of the hydraulic motor based on the operation amount thus detected; obtaining a torque command value of the hydraulic motor based on the target acceleration; determining as a non-regeneration state or as a regeneration state, based on the torque command value; coupling the flow rate control valve with the lift cylinder when determined as the non-regeneration state; and coupling the hydraulic pump with the lift cylinder and controlling an output of the hydraulic motor by controlling an inverter in accordance with the torque command value when determined as the regeneration state.

According to such a configuration, the torque command value of the hydraulic motor is obtained from the target acceleration obtained from the operation amount of the lift lever, and it is determined whether it is the non-regeneration state or the regeneration state from the torque command value thus obtained. When it is determined to be the non-regeneration state, the lift cylinder is coupled with the flow rate control valve. In contrast, when it is determined to be the regeneration state, the lift cylinder is coupled with the hydraulic pump and the hydraulic motor is controlled by using the inverter.

Thus, when it is determined that the regeneration is impossible and it is the non-regeneration state at the time of the lift-down operation, the lift cylinder is coupled to the flow rate control valve, whereby the lift-down operation like the conventional technique can be performed.

In contrast, when it is determined to be the regeneration state at the time of the lift-down operation, the lift cylinder is coupled to the hydraulic motor thereby to control the hydraulic motor by using the inverter. Thus, the potential energy of the forks and the potential energy of a baggage can be regenerated and utilized effectively.

DETAILED DESCRIPTION OF THE PREFERRED EMBODIMENTS

Figure 1:
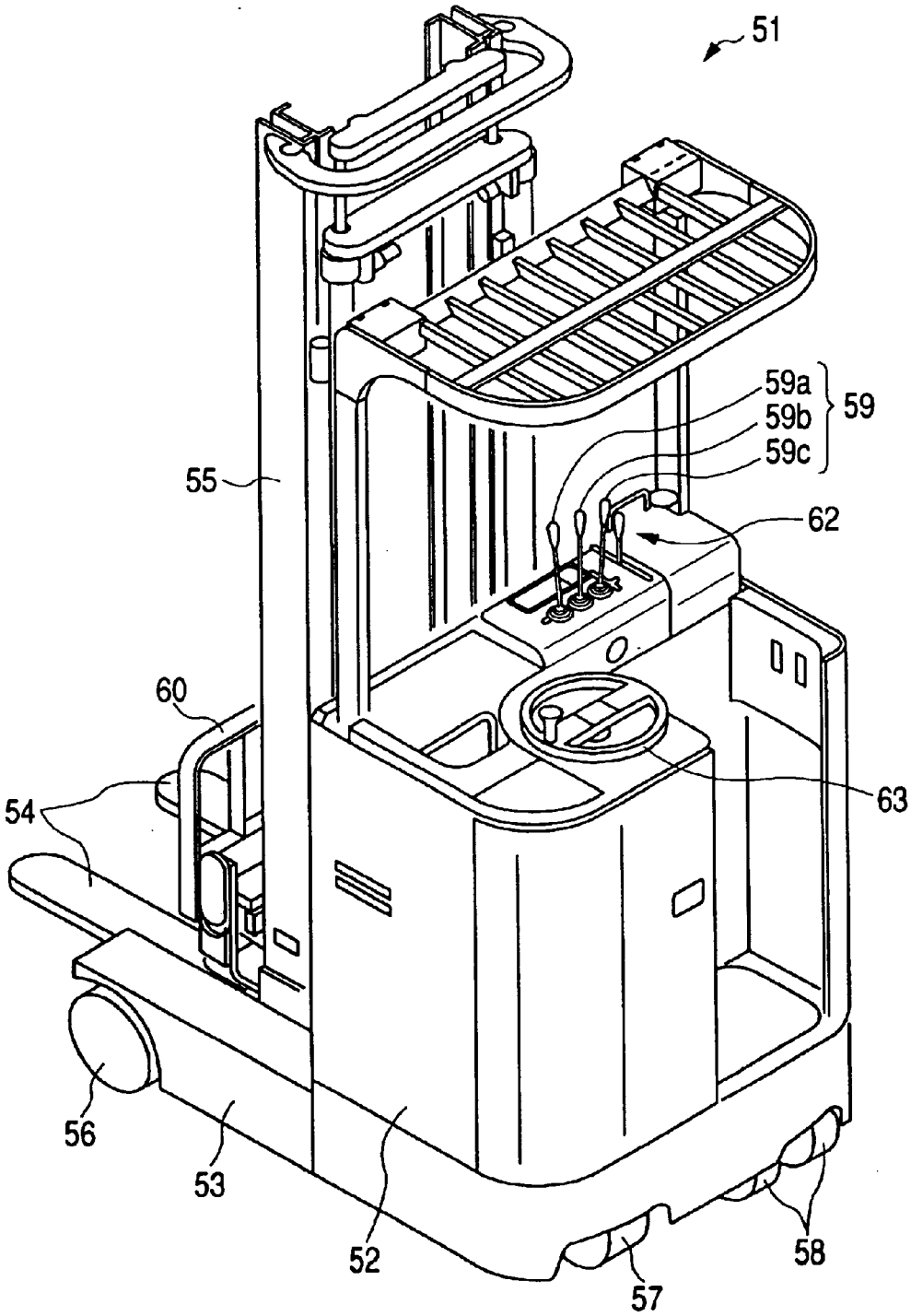
FIG. 1 is a perspective view of a reach type forklift according to an embodiment of the invention.
Figure 2:
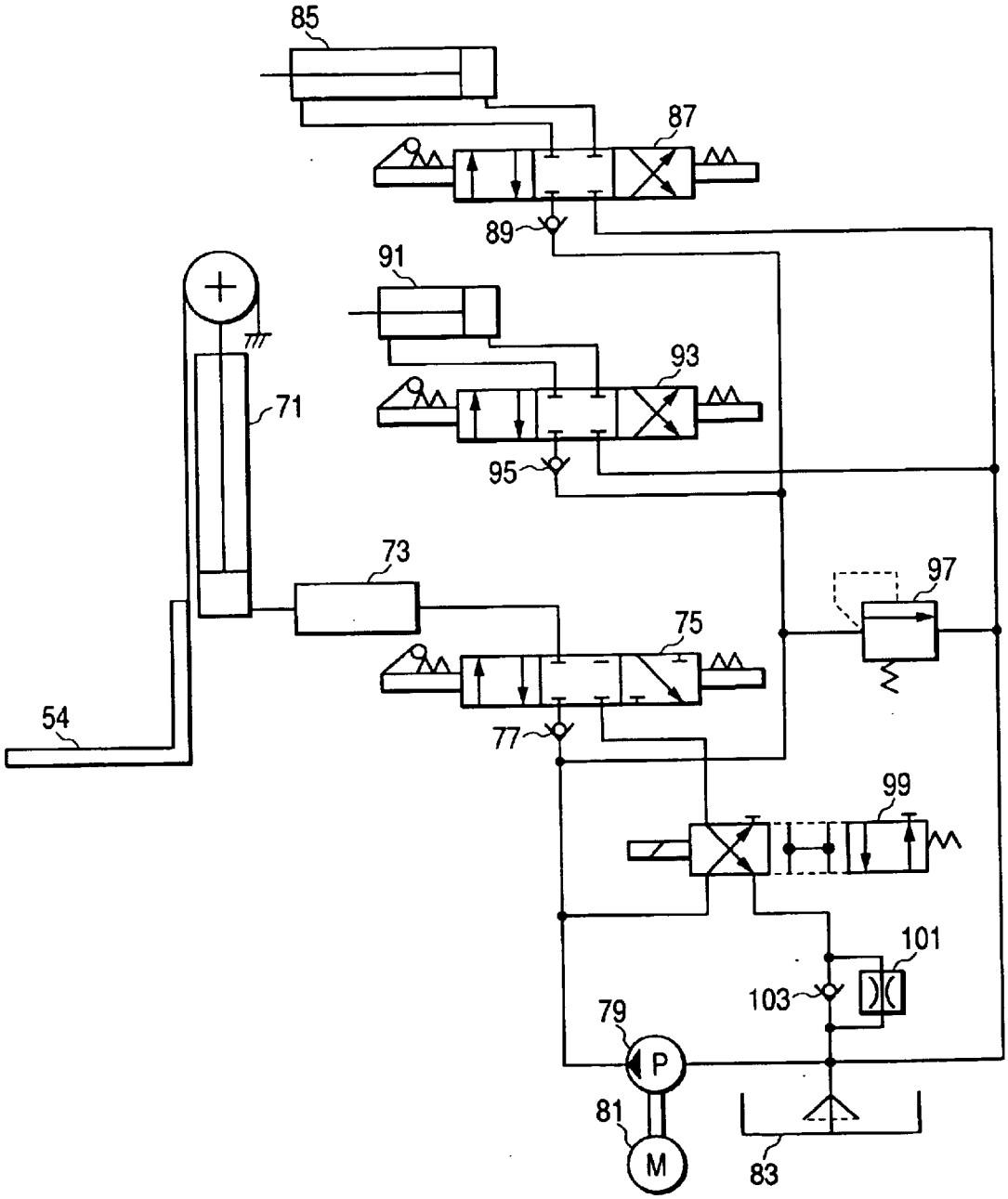
FIG. 2 is a hydraulic circuit diagram of the reach type forklift according to the embodiment of the invention.
Figure 3:
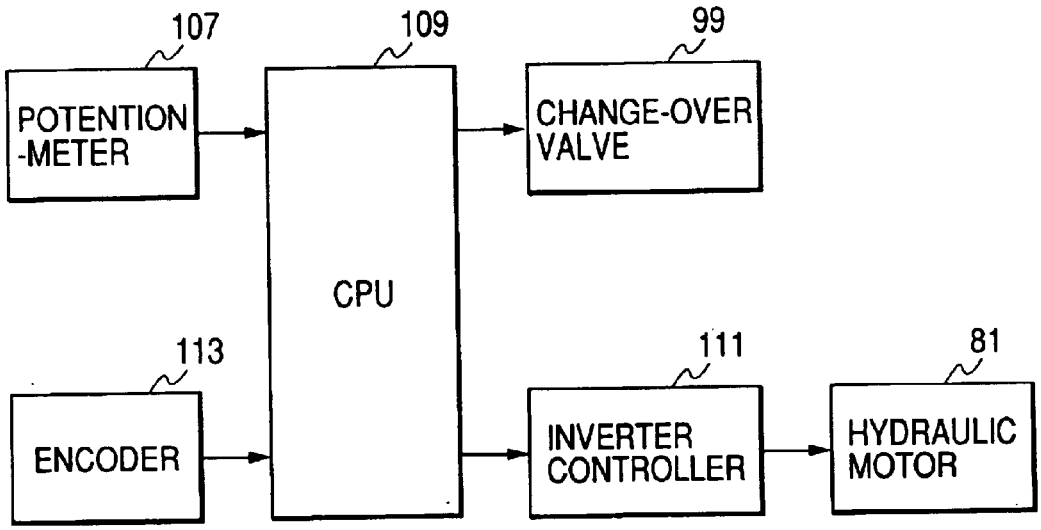
FIG. 3 is a block diagram of a control system according to the embodiment of the invention.
Figure 4A:
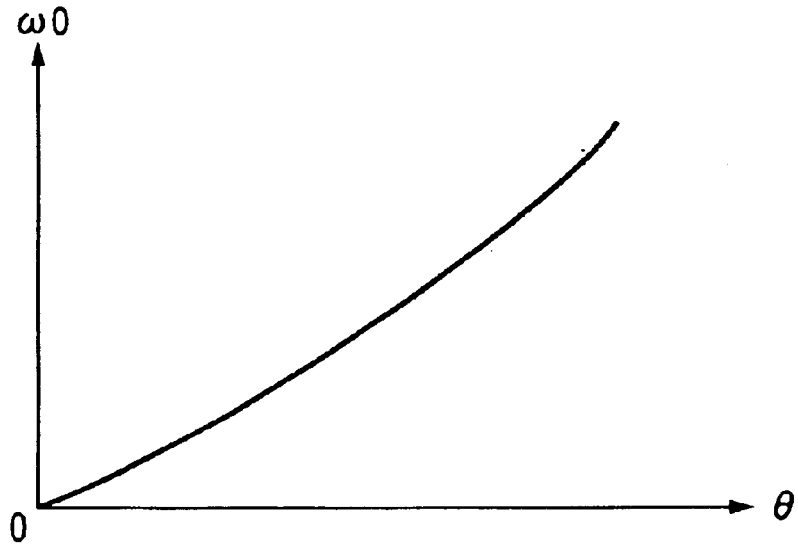
FIGS. 4A and 4B are diagrams for explaining the operation of the embodiment of the invention.
Figure 4B:
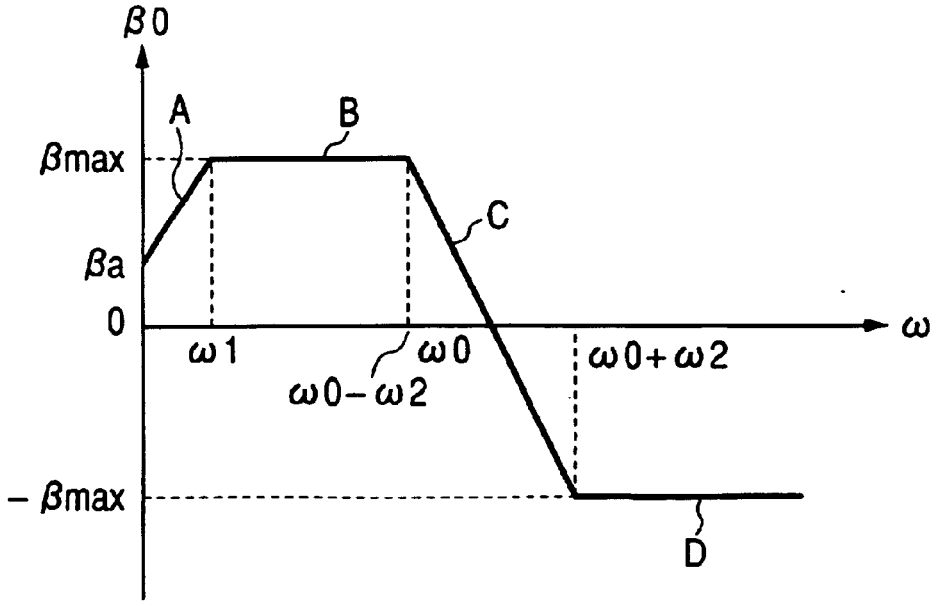
Figure 5:
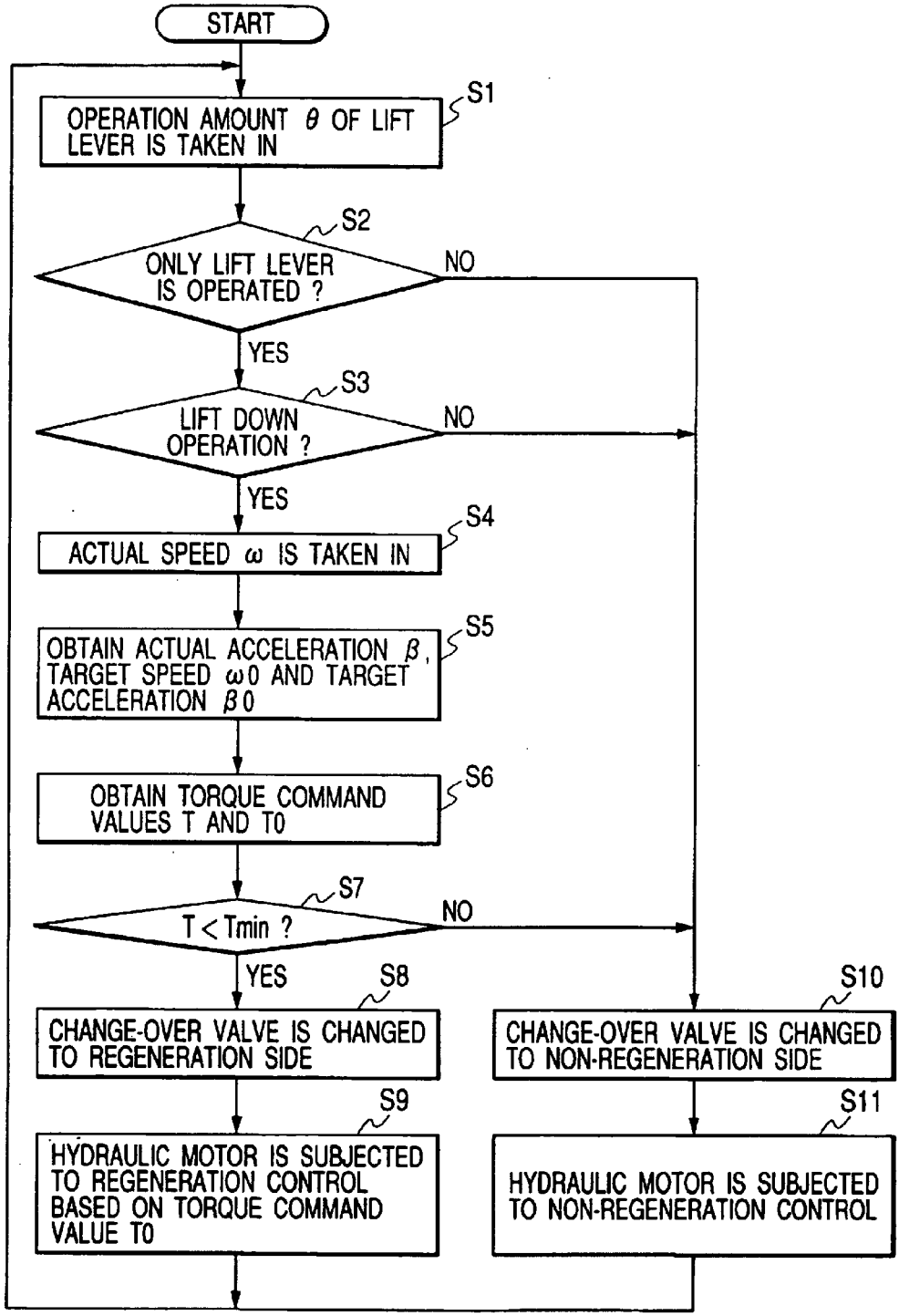
FIG. 5 is a flow chart for explaining the operation of the embodiment of the invention.
Figure 6:
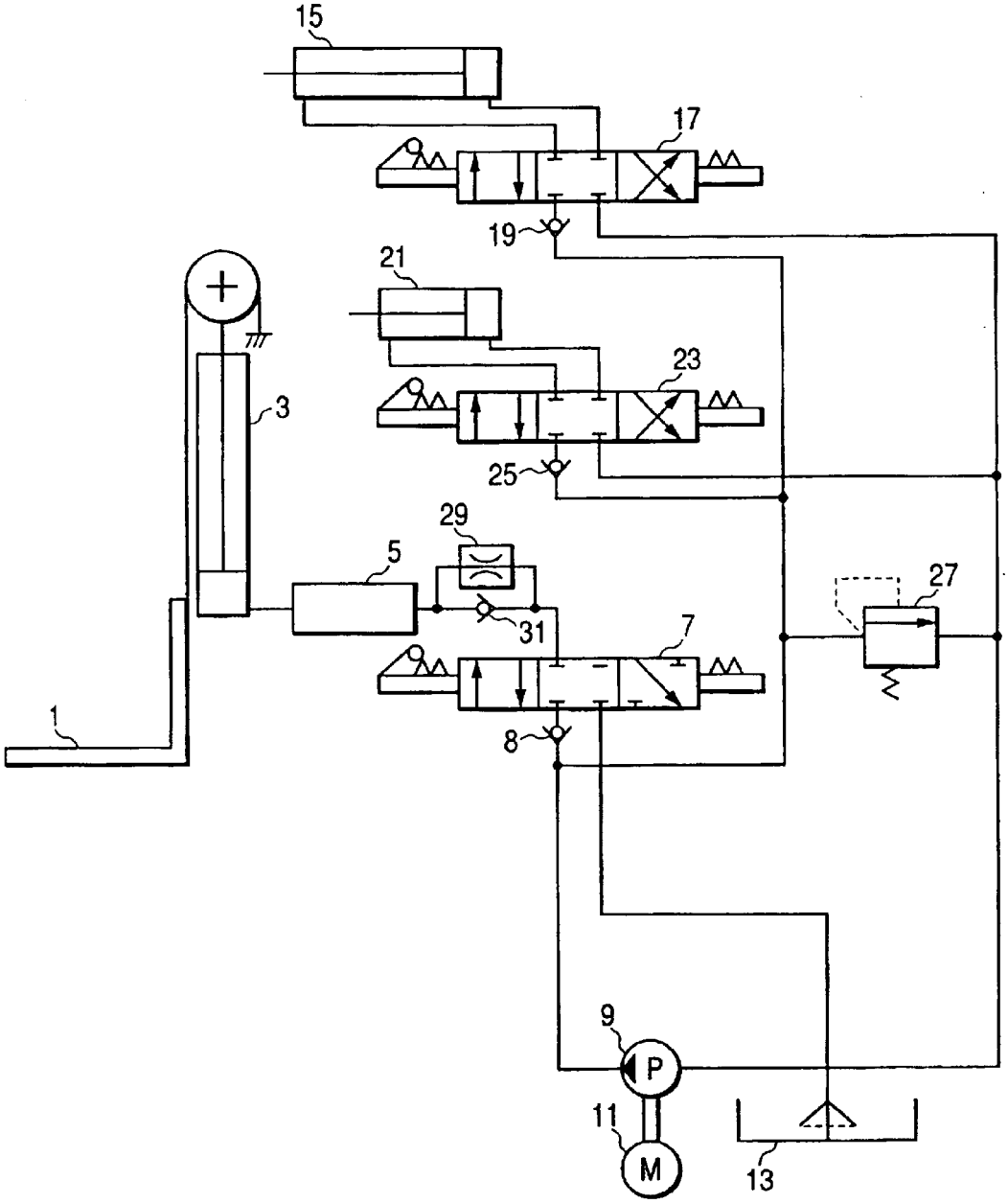
FIG. 6 PRIOR ART
FIG. 6 is a hydraulic circuit diagram of a onventional example.

An embodiment to which the invention is applied to a reach type forklift will be explained with reference to FIGS. 1 to 5. FIG. 1 shows a perspective view of the reach type forklift, FIG. 2 is a hydraulic circuit diagram of the reach type forklift shown in FIG. 1, FIG. 3 is a block diagram of a control system, FIGS. 4A and 4B are diagrams for explaining the operation thereof and FIG. 5 is a flow chart for explaining the operation thereof.

The reach type forklift according to the embodiment is configured as shown in FIG. 1. Pair of straddle arms 53 are fixed so as to protrude forward at left and right ends of the front portion of a vehicle body 52 of the reach type forklift, respectively. A mast 55, on which a lift cylinder 71 (not shown in FIG. 1) is disposed, is provided between the straddle arms 53 so as to be able to move forward and backward. Pair of L-shaped forks 54, which are lifted up and down by the lift cylinder 71, are guided by the mast 55 through a tilt bracket 60.

Left and right driven wheels 56 are attached to the both straddle arms 53 so as to rotate freely, respectively. At the lower portion of the rear portion of the vehicle body 52, a driving wheel 57 is attached and also two caster wheels 58 are attached so as to support the vehicle body 52. The caster wheels 58 are driven in accordance with the movement of the vehicle body 52.

Further, as shown in FIG. 1, at a driver's seat portion provided at the vehicle body 52 serving as a space at which a driver rides in a standing manner, there are disposed various kinds of hydraulic operation levers 59 such as a lift lever 59*a* for lifting up and down the forks 54, a reach lever 59*b* for moving the forks 54 forward and backward, and a tilt lever 59*c* for adjusting the inclination of the forks 54.

A hydraulic motor 81 (not shown) described later is driven based on a control command value according to the lift-up operation of the lift lever 59*a*, then the lift cylinder 71 is operated to extend the mast 55, and so the forks 54 attached to the mast 55 through the tilt bracket 60 are lifted up. Similarly, the hydraulic motor 81 is driven based on a control command value according to the operation of the reach lever 59*b*, and so a reach cylinder 85 (not shown) is operated thereby to move the forks 54 together with the mast 55 forward and backward. Further, the hydraulic motor 81 is driven based on a control command value according to the operation of the tilt lever 59*c*, and so a tilt cylinder 91 (not shown) is operated thereby to tilt the forks 54.

An acceleration lever 62 for rotationally driving the driving wheel 57 is disposed at the driver's seat portion of the vehicle body 52. The running direction in the forward or backward direction and the running speed of the vehicle body 52 is determined through the tilting operation of the acceleration lever 62. Further, a steering handle 63 is disposed at the driver's seat portion of the vehicle body 52. When the direction of the driving wheel 57, that is, the steering angle is controlled in accordance with the rotating operation of the steering handle 63 during the running state, the turning run can be performed.

Although not shown in FIG. 1, a brake pedal being operated by a driver is disposed at the vehicle body 52. A deadman brake formed by a disk brake is provided which locks the rotation shaft of a running motor for driving the driving wheel 57 thereby to brake the driving wheel 57. The locking state of the running motor is cancelled and the braking by the deadman brake is cancelled when the brake pedal is depressed. When depression of the brake pedal is released, the rotation shaft of the running motor is locked by the deadman brake to brake the driving wheel 57. Thus, in the event of an abnormal state etc., when the driver release the depression of the brake pedal, the deadman brake is operated to stop the vehicle.

Within the vehicle body 52 beneath the steering handle 63, a housing portion covered by a partition cover, which can be opened, is provided. A battery is housed within the housing portion. The battery supplies electric power to the respective portions of the forklift 51 such as the running motor, the hydraulic motor 81 etc. and also to a CPU 109 described later for controlling these respective portions.

The hydraulic circuit of the forklift 51 configured in this manner is constituted as shown in FIG. 2. The lift cylinder 71 for lifting up and down the forks 54 is coupled to a hydraulic pump 79 through a valve 73, a lift control valve (hereinafter called as a lift valve) 75 which is changed over between a lift-up side (the left side in FIG. 2) and a lift-down side (the right side in FIG. 2) by the operation of the lift lever 59*a*, and a check valve 77. The hydraulic pump 79 is driven by the hydraulic motor 81, whereby oil reserved within an oil tank 83 is supplied to the lift cylinder 71. The hydraulic motor 81 is formed by a three-phase AC motor.

Further, as shown in FIG. 2, a reach cylinder 85 for moving the forks 54 together with the mast 55 in the forward and backward direction is coupled to a reach control valve (hereinafter called as a reach valve) 87 which is changed over between a reach-in side (the left side in FIG. 2) and a reach-out side (the right side in FIG. 2) by the operation of the reach lever 59*b*. The reach valve 87 is coupled to the hydraulic pump 79 through a check valve 89 and also coupled to the oil tank 83.

Further, as shown in FIG. 2, a tilt cylinder 91 for tilting the forks 54 is coupled to a tilt control valve (hereinafter called as a tilt valve) 93 which is changed over between a tilt-up side (the left side in FIG. 2) and a tilt-down side (the right side in FIG. 2) by the operation of the tilt lever 59*c*. The tilt valve 93 is coupled to the hydraulic pump 79 through a check valve 95 and also coupled to the oil tank 83.

Furthermore, as shown in FIG. 2, a relief valve 97 is disposed between a coupling tube on the oil tank side of the reach valve 87 and a coupling tube on the oil tank side of the tilt valve 93. An electromagnetic type change-over valve 99 serving as a change-over member and a flow rate control valve 101 are disposed at a feedback path for feedbacking the oil to the oil tank 83 at the time of the lift-down operation of the lift cylinder 71. The flow rate control valve 101 is coupled to the change-over valve 99 and the oil tank 83 so as to limit a flow rate of the oil flowing from the change-over valve 99 to the oil tank 83. A check valve 103 is coupled in parallel to the flow rate control valve 101 so as to prevent the oil from flowing into the oil tank 83 from the change-over valve 99.

When it is determined to be regeneration by a controller described later at the time of the lift down operation, the change-over valve 99 is changed over to a regeneration side (the right side in FIG. 2). In contrast, when it is determined to be non-regeneration at the time of the lift down operation, the change-over valve 99 is changed over to a non-regeneration side (the left side in FIG. 2) so that the return oil from the lift cylinder 71 is fed back to the oil tank 83 through the valve 73, the lift valve 75, the change-over valve 99 and the flow rate control valve 101.

Next, the configuration of the control system will be explained. As shown in FIG. 3, a potentiometer 107 serving as an operation amount detector is provided so as to detect respective operation amounts θ of the lift lever 59*a* to the lift-up side and the lift-down side from a neutral state. The detected operation amount of the potentiometer is taken into the CPU 109 that serves as a controller.

The CPU 109 controls the change-over valve 99 so as to change over it as described above and also controls an inverter controller 111 formed by an inverter circuit thereby to control a current supplied to the hydraulic motor 81. Further, as shown in FIG. 3, an encoder 113 serving as a speed detector is provided. The encoder 113 detects an actual rotation speed (hereinafter called as an actual speed) ω of the hydraulic motor 81 and the CPU 109 takes in the actual speed ω detected by the encoder 113.

The CPU 109 obtains a target speed ω0 and a target acceleration β0 of the hydraulic motor 81 at the time of the lift down operation from the operation amount θ of the lift lever 59*a* detected by the potentiometer 107 and also obtains a torque command value T0 of the hydraulic motor 81 from the target acceleration β0 at the time of the lift down operation. Then, the CPU determines non-regeneration state or the regeneration state from the torque command value T0 thus obtained.

To be explained more in detail, the CPU 109 performs time-differentiation as to the actual speed ω detected by the encoder 113 to obtain an actual acceleration β. The operation amount θ of the lift lever 59*a* detected by the potentiometer 107 and the target speed ω0 of the hydraulic motor 81 at the time of the lift down operation are set in advance to be in an almost proportion relation to each other as shown in FIG. 4A. The target speed ω0 is obtained from the operation amount θ detected by the potentiometer 107 based on this relation. The relation date of the target acceleration β0 with respect to the operation amount θ detected by the potentiometer 107 as shown in FIG. 4B is stored in advance in an internal or built-in memory (not shown) formed by a ROM, for example, serving as a storage portion. The relation data is read out and the target acceleration β0 corresponding to the actual speed ω and the target speed ω0 is obtained. Further, the torque command value T0 is obtained from the actual acceleration β0 and the target acceleration β0 thus obtained.

The target acceleration β0 is set to have the following relations with respect to the target speed ω0 and the actual speed ω, as shown in FIG. 4B. That is, when ω is in a range (an range A in the figure) of $0<\omega\leqq\omega 1$, $$\beta 0=\beta a+\{(\beta max-\beta a)/\omega 1\}\times\omega \quad (1)$$

; when ω is in a range (an range B in the figure) of $\omega 1<\omega\leqq\omega 0-\omega 2$, $$\beta 0=\beta max \quad (2)$$

; when ω is in a range (an range C in the figure) of $\omega 0-\omega 2<\omega\leqq\omega 0+\omega 2$, $$\beta 0=(\beta max/\omega 2)\times\omega 0-(\beta max/\omega 2)\times\omega \quad (3)$$

; and when ω is in a range (an range D in the figure) of $\omega>\omega 0+\omega 2$, $$\beta 0=-\beta max \quad (4)$$

, where βmax, βa, ω1 and ω2 are values (relation datas) set in advance in accordance with the characteristics of the hydraulic motor 81 and stored in the built-in memory serving as the storage portion. The CPU 109 obtains the target acceleration β0 in accordance with the calculation based on one of the expressions (1) to (4). Such a processing of the CPU 109 for obtaining the target acceleration β0 corresponds to a target acceleration obtaining means.

Further, the CPU 109 obtains the torque command value T0 by using the actual acceleration β0 and the target acceleration β0 thus obtained in accordance with the following expression, $$T0=kt1\times(\beta 0-\beta)+kt2\times\int(\beta 0-\beta)dt \quad (5)$$

where kt1 and kt2 are coefficients and set in advance in accordance with the characteristics of the hydraulic motor 81 and stored in the built-in memory serving as the storage portion. The torque command value T0 is set to be positive in the direction where the hydraulic motor 81 is rotated in the forward direction.

Further, in order to control stably, the CPU 109 performs a so-called filtering processing which obtains the torque command value T used for determining the change-over of the change-over valve 99 by using the first-order lag of the torque command value T0 in accordance with the following expression, $$T(s)=T0(s)/(1-s/\tau) \quad (6)$$

, where τ represents a lag time-constant and s a Laplace operator. Such a processing of the CPU 109 for obtaining the torque command value T0 and the torque command value T corresponds to a torque command value obtaining means.

Then the CPU 109 compares the torque command value T obtained from the expression (6) with a predetermined value Tmin thereby to determine to be the regeneration state when $T\geqq Tmin$ and to be the non-regeneration state when $T<Tmin$. Such a determining processing of the CPU 109 for determining based on the torque command value T whether it is the regeneration state or the non-regeneration state corresponds to a determining means. In this respect, Tmin is a negative value. Further, the determination as to whether it is the regeneration state or the non-regeneration state may be made by using a suitable hysteresis characteristics.

When the CPU 109 determines to be the non-regeneration state, the CPU changes over the change-over valve 99 (to the left side in FIG. 2) so as to couple the lift cylinder 71 with the flow rate control valve 101. In contrast, when the CPU determines to be the regeneration state, the CPU changes over the change-over valve 99 (to the right side in FIG. 2) so as to couple the lift cylinder 71 with the hydraulic pump 79 thereby to operate the hydraulic motor 81 as a generator by using the reverse rotation of the hydraulic pump 79 due to the oil flowing into the hydraulic pump 79 from the lift cylinder 71 to regenerate electric energy generated by the hydraulic motor 81 to the battery. In this case, the CPU 109 controls the inverter controller 111 so as to subject the hydraulic motor to the regeneration control so that the output of the hydraulic motor 81 becomes the torque command value T0. Such a change-over processing of the change-over valve 99 and a regeneration control processing through the inverter controller 111 by the CPU 109 corresponds to a change-over control means.

Next, the operation of the control system will be explained with reference to FIG. 5. As shown in FIG. 5, at first, the operation amount θ of the lift lever 59*a* detected by the potentiometer 107 is taken into the CPU 109 (S1), and it is determined whether or not only the lift lever 59*a* is operated (S2). When the determination result at step S2 is Yes, it is determined whether or not the lift lever 59*a* is operated to perform the lift-down operation (S3).

When the determination result at step S3 is Yes, the CPU 109 takes in the actual speed ω of the hydraulic motor 81 detected by the encoder 113 (S4). Then, the CPU 109 obtains the actual acceleration β, the target speed ω0 and the target acceleration β0 of the hydraulic motor 81 (S5) and further obtains the torque command value T0 through the calculation of the expression (5) and the torque command value T through the calculation of the expression (6) (S6).

The CPU 109 compares the torque command value T thus obtained with Tmin thereby to determine whether or not the torque command value satisfies the relation of T<Tmin (S7). When the determination result at step S7 is Yes, it is considered that the magnitudes of the potential energy of the forks 54 and the potential energy of the baggage are large sufficient for capable of being regenerated. Thus, the change-over valve 99 is changed over to the regeneration side (the right side in FIG. 2) (S8), whereby the hydraulic motor 81 is subjected to the regeneration control by the inverter controller 111 based on the torque command value T0 from the CPU 109 and then the process returns to step S1.

When the determination result at step S2 is No, since either one of the reach lever 59*b* and the tilt lever 59*c* is operated simultaneously with the lift lever 59*a*, it is determined that the regeneration control of the hydraulic motor 81 can not be performed. Thus, the change-over valve 99 is changed over to the non-regeneration side (the left side in FIG. 2) (S10), the hydraulic motor 81 is subjected to the non-regeneration control. That is, the hydraulic motor is rotated in the forward direction so as to supply the oil to the reach cylinder 85 or the tilt cylinder 91 (S11).

When the determination result at step S3 is No, since the lift lever 59*a* is subjected to the lift-up operation, it is determined that the regeneration control of the hydraulic motor 81 can not be performed. Thus, the change-over valve 99 is changed over to the non-regeneration side, that is, the left side in FIG. 2 (S10), the hydraulic motor 81 is subjected to the non-regeneration control. That is, the hydraulic motor is rotated in the forward direction so as to supply the oil to the lift cylinder 71 (S11).

When the determination result at step S7 is No, it is considered that the magnitudes of the potential energy of the forks 54 and the potential energy of the baggage are not so large for performing regeneration sufficiently. Thus, like the case where the determination result at step S2 or S3 is No, the process proceeds to step S10 and the change-over valve 99 is changed over to the non-regeneration side (the left side in FIG. 2) (S10), whereby the hydraulic motor 81 is subjected to the non-regeneration control. That is, in this case, the hydraulic motor 81 is stopped (S11).

In this manner, according to the embodiment, it is determined to be the non-regeneration state in the case where the lift lever 59*a* is operated simultaneously with another hydraulic operation lever and so the regeneration using the hydraulic pump 79 and the hydraulic motor 81 can not be performed, or the case where the lift lever 59*a* is subjected to the lift-up operation and so the regeneration using the potential energy can not be performed, or the case where it is considered to be improper to perform the regeneration since such a harmful effect that the lift-down speed becomes too small is attended (that is, the effective regeneration can not be performed). Thus, the change-over valve 99 is changed over to the non-regeneration side (the left side in FIG. 2) (S10), whereby the hydraulic motor 81 is subjected to the non-regeneration control (S11).

Thus, according to the embodiment, at the time of the lift-down operation by the operation of only the lift lever 59*a*, when it is considered that the magnitudes of the potential energy of the forks 54 and the potential energy of the baggage are large sufficient for capable of being regenerated, the change-over valve 99 is changed over thereby to couple the lift cylinder 71 to the hydraulic pump 79. Then, the hydraulic motor 81 is subjected to the regeneration control, whereby the potential energy of the forks 54 and the potential energy of the baggage is regenerated and can be utilized effectively.

The CPU 109 obtains the actual acceleration β of the hydraulic motor 81 from the actual speed ω detected by the encoder 113, then obtains the target acceleration β0 based on the target speed ω0 of the hydraulic motor 81 obtained from the operation amount θ of the lift lever 59*a* detected by the potentiometer 107, and obtains the torque command values T0 and T from the actual acceleration β0 and the target acceleration β0 thus obtained. Then, the CPU determines by using the torque command values T0 and T of the hydraulic motor 81 whether it is the non-regeneration state or the regeneration state and further controls the output of the hydraulic motor 81. Thus, it is possible to accurately determine as to whether it is the non-regeneration state or the regeneration state and further the output of the hydraulic motor 81 can be controlled suitably. As a result, the potential energy of the forks 54 and the potential energy of the baggage can be regenerated effectively to the battery.

The following embodiment may be implemented by applying the aforesaid embodiment. That is, according to the aforesaid embodiment, the CPU 109 serving as the determining means determines to be the non-regeneration state when the torque command value T obtained from the expression (6) is T≧Tmin, whilst determines to be the regeneration state when T<Tmin. In contrast, in this embodiment, it may be determined to be the non-regeneration state (that is, can not be regenerated) when the torque command value T is T≧Tf, whilst determined to be able to regenerate at a low level when Tr≦T<Tf, and determined to be able to regenerate at a high level when T<Tr. In this respect, "capable of being regenerated at the low level" means that although the magnitudes of the potential energy of the forks 54 and the potential energy of the baggage are small and the lift-down speed at the regeneration is smaller than a predetermined value V, the regeneration can be performed. Further, "capable of being regenerated at the high level" means that the magnitudes of the potential energy of the forks 54 and the potential energy of the baggage are large and the regeneration can be performed without making the lift-down speed at the regeneration smaller than the predetermined value V. When it is determined that the regeneration at the high level or the low level can be performed, the CPU 109 changes over the change-over valve 99 to the regeneration side (the right side in FIG. 2).

Further, in the aforesaid embodiment, the CPU 109 changes over the change-over valve 99 to the regeneration side (the right side in FIG. 2) and the hydraulic motor 81 is controlled, the control of the hydraulic motor 81 at this time means that the hydraulic motor 81 is operated as a generator and electric energy generated by the hydraulic motor 81 is regenerated to the battery. In contrast, in this embodiment, different controls are performed depending on whether the regeneration at the high level or the regeneration at the low level is possible. To be more concrete, when the CPU 109 determines that the torque command value satisfies T<Tr and so the regeneration at the high level is possible, the CPU operates the hydraulic motor 81 as a generator and regenerate electric energy generated by the hydraulic motor 81 to the battery. In contrast, when the CPU 109 determines that the torque command value satisfies Tr≦T<Tf and so the regeneration at the low level is possible, the CPU operate the hydraulic motor 81 to rotate in the reverse direction so that the lift-down speed becomes the predetermined value V thereby to forcedly collect the oil from the lift cylinder 71 to the oil tank 83.

According to this embodiment, the regeneration can be performed only when the effective regeneration is possible, and the lift-down speed can be always kept at the predetermined value V irrespective of the magnitude of the weight of a baggage.

Although in the aforesaid embodiment, the potentiometer 107 is employed as the operation amount detector for detecting the operation amount of the lift lever 59*a*, the operation amount detector is not necessarily limited to the potentiometer.

Further, although in the aforesaid embodiment, the explanation is made as to the case of employing the electromagnetic type change-over valve 99 as the change-over member, the change-over member is not limited to the electromagnetic type change-over valve but may be a change-over valve which can be changed over in accordance with an electric signal supplied from outside (for example, the CPU 109).

Further, although in the aforesaid embodiment, the explanation is made as to the case where the invention is applied to a reach-type forklift, of course, the invention may be applied to other types of forklifts such as a counter balance type forklift other than the reach-type forklift. In such a case, the effects similar to the aforesaid embodiment can be obtained.

The invention is not limited to the aforesaid embodiments and may be modified in various manners without departing from the gist of the invention.

As described above, according to the invention, at the time of the lift-down operation, when it is considered that the magnitudes of the potential energy of the forks and the potential energy of the baggage are large sufficient for capable of being regenerated, the lift cylinder is coupled to the hydraulic pump and the hydraulic motor is controlled so as to be operated as a generator thereby to regenerate electric energy. Further, such a regeneration can be performed with the configuration of a low cost without adding any particular control circuit for the regeneration.

According to the invention, the change-over member can be controlled so as to be changed over with good responsibility in accordance with an electric signal from the outside.

According to the invention, the potentiometer can detect whether the lift lever is operated to the lift-up side or the lift-down side and also detect the operation amount of the lift lever accurately.

According to the invention, it is possible to accurately determine as to whether it is the non-regeneration state or the regeneration state and further the output of the hydraulic motor can be controlled suitably.

According to the invention, the oil can be supplied from the hydraulic pump to the cylinder different from the lift cylinder without causing any trouble, so that there is no fear that the working efficiency is degraded.

What is claimed is:

1. A control apparatus for a forklift having a lift lever; a hydraulic motor; a hydraulic pump; an oil tank; and a lift cylinder, wherein, at a time of a lift-up operation based on an operation of the lift lever, the hydraulic motor drives the hydraulic pump to supply oil from the oil tank to the lift cylinder by the hydraulic pump thereby to extend the lift cylinder, whilst at a time of a lift-down operation based on an operation of the lift lever, the oil is collected to the oil tank from the lift cylinder due to a shrinking operation of the lift cylinder, the control apparatus comprising:

an inverter controller for controlling an output of the hydraulic motor; a flow rate control valve, coupled to the oil tank, for limiting a flow rate of the oil collected to the oil tank;

a change-over member for selectively coupling the lift cylinder to the flow rate control valve or to the hydraulic pump;

an operation amount detector for detecting an operation amount of the lift lever;

a target acceleration obtaining means for obtaining a target acceleration of the hydraulic motor based on the operation amount detected by the operation amount detector;

a torque command value obtaining means for obtaining a torque command value of the hydraulic motor based on the target acceleration;

a determining means for determining as a non-regeneration state or as a regeneration state, based on the torque command value; and a change-over control means for changing over the change-over member so as to couple the lift cylinder to the flow rate control valve when determined as the non-regeneration state, and for changing over the change-over member so as to couple the lift cylinder to the hydraulic pump and making the inverter controller control the hydraulic motor in accordance with the torque command value when determined as the regeneration state.

2. The control apparatus for a forklift according to claim 1, wherein the change-over member is provided with an electromagnetic type change-over valve.

3. The control apparatus for a forklift according to claim 1, wherein the operation amount detector is formed by a potentiometer for detecting operation amounts of the lift lever operated to a lift-up side and a lift-down side.

4. The control apparatus for a forklift according to claim 1, further comprising a speed detector for detecting an actual rotation speed of the hydraulic motor, wherein the target acceleration obtaining means obtains an actual acceleration of the hydraulic motor based on the actual rotation speed detected by the speed detector and obtains the target acceleration of the hydraulic motor based on the operation amount detected by the operation amount detector, and wherein the torque command value obtaining means obtains the torque command value based on a difference between the actual acceleration and the target acceleration.

5. The control apparatus for a forklift according to claim 4, wherein the target acceleration obtaining means includes a storage portion for storing relation data representing relation between the actual rotation speed and the target acceleration, and the target acceleration obtaining means obtains a target speed of the hydraulic motor based on the operation amount of the lift lever, then reads the relation data from the storage portion, and obtains the target acceleration through calculation using the actual rotation speed, the target speed and the relation data.

6. The control apparatus for a forklift according to claims 1, wherein the determining means determines as the non-regeneration state when the torque command value is equal to or more than a predetermined value and determines as the regeneration state when the torque command value is less than the predetermined value.

7. The control apparatus for a forklift according to claim 1, further comprising: a cylinder different from the lift cylinder; an operation lever different from the lift lever; and an operation detector for detecting an operation of the operation lever, wherein the cylinder performs an extending operation or a shrinking operation in response to the oil supplied by the hydraulic pump driven by the hydraulic motor based on an operation of the operation lever; and wherein the determining means determines as the non-regeneration state when the operation of the operation lever is detected by the operation detector irrespective of the torque command value.

8. A method of controlling a forklift having a lift lever; a hydraulic motor; a hydraulic pump; an oil tank; a lift cylinder; and a flow rate control valve coupled to the oil tank, wherein, at a time of a lift-up operation based on an operation of the lift lever, the hydraulic motor drives the hydraulic pump to supply oil from the oil tank to the lift cylinder by the hydraulic pump thereby to extend the lift cylinder, whilst at a time of a lift-down operation based on an operation of the lift lever, the oil is collected to the oil tank from the lift cylinder due to a shrinking operation of the lift cylinder, the method comprising:

detecting an operation amount of the lift lever;

obtaining a target acceleration of the hydraulic motor based on the operation amount thus detected;

obtaining a torque command value of the hydraulic motor based on the target acceleration;

determining as a non-regeneration state or as a regeneration state, based on the torque command value;

coupling the flow rate control valve with the lift cylinder when determined as the non-regeneration state; and coupling the hydraulic pump with the lift cylinder and controlling an output of the hydraulic motor by controlling an inverter in accordance with the torque command value when determined as the regeneration state.

9. A forklift comprising:

a lift lever;

a hydraulic motor;

a hydraulic pump;

an oil tank;

a lift cylinder; and a control apparatus including: an inverter controller for controlling an output of the hydraulic motor; a flow rate control valve, coupled to the oil tank, for limiting a flow rate of the oil collected to the oil tank; a change-over member for selectively coupling the lift cylinder to the flow rate control valve or the hydraulic pump; and an operation amount detector for detecting an operation amount of the lift lever, wherein at a time of a lift-up operation based on an operation of the lift lever, the hydraulic motor drives the hydraulic pump to supply oil from the oil tank to a lift cylinder by the hydraulic pump thereby to extend the lift cylinder, whilst at a time of a lift-down operation based on an operation of the lift lever, the oil is collected to the oil tank from the lift cylinder due to a shrinking operation of the lift cylinder, wherein the control apparatus obtains a target acceleration of the hydraulic motor based on the operation amount detected by the operation amount detector; the control apparatus obtains a torque command value of the hydraulic motor based on the target acceleration; the control apparatus determines as a non-regeneration state or as a regeneration state, based on the torque command value; and the control apparatus switches the change-over member so as to couple the lift cylinder to the flow rate control valve when determined as the non-regeneration state, and switches the change-over member so as to couple the lift cylinder to the hydraulic pump and making the inverter controller control the hydraulic motor in accordance with the torque command value when determined as the regeneration state.

* * * * *